US006763329B2

(12) United States Patent
Brandel et al.

(10) Patent No.: US 6,763,329 B2
(45) Date of Patent: Jul. 13, 2004

(54) METHOD OF CONVERTING THE SPEECH RATE OF A SPEECH SIGNAL, USE OF THE METHOD, AND A DEVICE ADAPTED THEREFOR

(75) Inventors: Cecilia Brandel, Lund (SE); Henrik Johannisson, Malmö (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 652 days.

(21) Appl. No.: 09/827,195

(22) Filed: Apr. 5, 2001

(65) Prior Publication Data

US 2002/0038209 A1 Mar. 28, 2002

Related U.S. Application Data

(60) Provisional application No. 60/197,194, filed on Apr. 14, 2000.

(30) Foreign Application Priority Data

Apr. 6, 2000 (EP) ..... 00610036

(51) Int. Cl.[7] ..... G10L 21/04
(52) U.S. Cl. ..... 704/207; 704/200
(58) Field of Search ..... 704/200, 201, 704/207, 278, 500

(56) References Cited

U.S. PATENT DOCUMENTS

| | | | | |
|---|---|---|---|---|
| 5,717,823 A | * | 2/1998 | Kleijn | 704/220 |
| 5,828,995 A | | 10/1998 | Satyamurti et al. | 704/211 |
| 5,933,808 A | | 8/1999 | Kang et al. | 704/278 |
| 6,311,154 B1 | * | 10/2001 | Gersho et al. | 704/219 |

FOREIGN PATENT DOCUMENTS

| | | |
|---|---|---|
| EP | 0 817 168 | 1/1998 |
| EP | 0 883 106 | 12/1998 |

OTHER PUBLICATIONS

Ramos Sánchez, U., European Search Report, Application No. EP 00 61 0036, Sep. 8, 2000, pp. 1–3.
Nejime, Y. et al., "A Portable Digital Search–Rate Converter for Hearing Impairment," IEEE Transactions on Rehabilitation Engineering, vol. 4, No. 2, Jun. 1996, pp. 73–83.
Brandel, C. et al. "Speech Enhancement by Search Rate Conversion." MSC Thesis, University of Karlskrona/Ronneby XP002169594 1999. pp. 41–46.
Form PCT/ISA/210 International Search Report for PCT/EP 01/03491. (4 pages).

* cited by examiner

*Primary Examiner*—Susan McFadden
(74) *Attorney, Agent, or Firm*—Jenkens & Gilchrist, P.C.

(57) ABSTRACT

A method of converting the speech rate of a speech signal with a pitch period below a maximum expected pitch period comprises the steps of dividing the speech signal into segments, estimating the pitch period in a segment, copying a fraction of the speech signal in the segment, said fraction having a duration equal to said estimated pitch period, providing from the fraction an intermediate signal having the same duration, and expanding the segment by inserting the intermediate signal pitch synchronously into the speech signal of the segment. A segment size longer than the maximum expected pitch period but shorter than twice the maximum expected pitch period is used. A considerably smaller amount of data has to be processed for each segment, so that the method can be implemented with the limited computational resources of e.g. a mobile telephone. A similar device is also provided.

17 Claims, 7 Drawing Sheets

Figure 1:
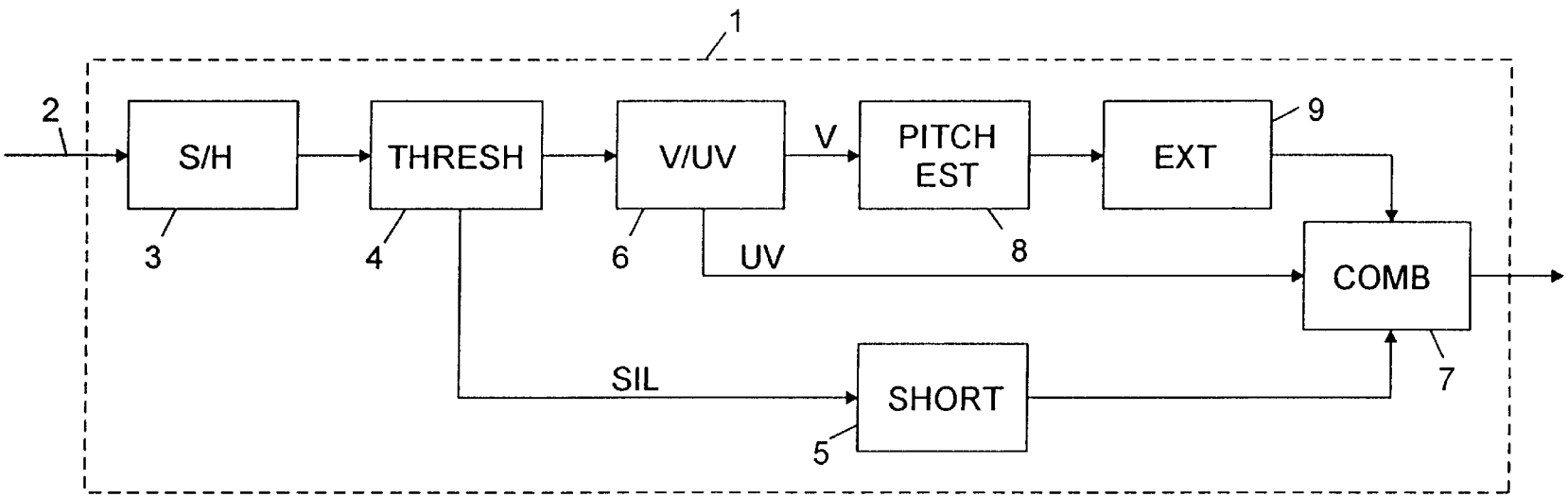

METHOD OF CONVERTING THE SPEECH RATE OF A SPEECH SIGNAL, USE OF THE METHOD, AND A DEVICE ADAPTED THEREFOR

CROSS REFERENCES TO RELATED APPLICATIONS

This application for patent claims the benefit of priority from, and hereby incorporates by reference the entire disclosure of, co-pending U.S. Provisional Application for Patent Serial No. 60/197,194, filed Apr. 14, 2000.

The invention relates to a method of converting the speech rate of a speech signal having a pitch period below a maximum expected pitch period. The method comprises the steps of dividing the speech signal into segments, estimating the pitch period of the speech signal in a segment, copying a fraction of the speech signal in the segment, said fraction having a duration equal to said estimated pitch period, providing from said fraction an intermediate signal having the same duration, and expanding the segment by inserting said intermediate signal pitch synchronously into the speech signal of the segment. The invention also relates to the use of the method in a mobile telephone. Further, the invention relates to a device adapted to convert the speech rate of a speech signal.

In many situations it is desirable to enhance the intelligibility of speech. Especially elderly people are often troubled by some hearing impairment, which among other things lowers their comprehension of speech uttered rapidly. Also children with language-learning difficulties could benefit from an improved intelligibility. Further, when mobile telephones are used in noisy environments it can be difficult to fully understand what is being said. This difficulty occurs not only for hearing impaired people, but also for anybody else. Therefore, there is an increasing demand for obtaining an enhanced intelligibility in mobile telephones.

One way of enhancing the intelligibility of the speech is to slow down the speech. The principal objective of this approach is to give the listener some extra time to recognize what is being said. This can be obtained by using time-scaling techniques, which means that the temporal evolution of the signal is changed. The speech rate is adjusted by adding extra time data to the signal according to a chosen algorithm.

Several speech enhancement algorithms exist that are based on the technique of slowing down input speech. The fundamental idea of these algorithms is to perform an extension of the speech that preserves the natural quality of the speech while the intelligibility is raised. Thereby most extension algorithms are dependent on the pitch periodicity of the speech. However, such algorithms have not been suitable for implementation in mobile telephones.

A device utilizing such an algorithm is known from the article Y. Nejime, T. Aritsuka, T. Imamura, T. Ifukube, and J. Matsushima, "A Portable Digital Speech-Rate Converter for Hearing Impairment", IEEE Transactions on Rehabilitation Engineering, vol. 4, no. 2, pp. 73–83, June 1996. The device is a hand-sized portable device that converts the speech rate without changing the pitch. When the speech speed is slowed, a time delay occurs between the input and the output speech. The speech signals are recorded into a solid-state memory while previously recorded signals are being slowed and generated. The user activates the device by holding down a button on the device. The longer the user holds the button to slow the speech, the longer the delay. Although the delay may be reduced by cutting silent intervals in excess of one second, this is not sufficient to eliminate the delay. The user can return to non-delay by releasing the button.

The speech data in the memory are partitioned into frames. The time-scaling process expands the time scale of the speech data frame by frame. The time expansion is obtained by inserting a composite pitch pattern created from the signal of three consecutive pitch periods. The composite pattern is used in order to avoid reverberation of the expanded signal. Because the time-scaling process used needs four-pitch-length data elements, the length of each frame is 48 ms corresponding to four times the assumed maximum pitch interval which is set to 12 ms in this document. Other documents mention assumed maximum pitch periods of 16 ms or even close to 20 ms, which would necessitate even longer frame lengths and thus larger amounts of data to be processed for each frame.

Especially this amount of data to be processed makes the above algorithm less interesting for use in mobile telephones, because the computational resources in a mobile telephone are severely limited. Another drawback of the algorithm is the time delay that can be accumulated while the user holds the button of the device. The use of a mobile phone is almost always a two-way communication between two persons, and therefore it is desired to keep the expanded speech as close to real time as possible.

It is an object of the invention to provide a method of the above-mentioned type in which a considerably smaller amount of data has to be processed for a frame, so that the method can be implemented with the limited computational resources of e.g. a mobile telephone.

According to the invention, this object is achieved in that a segment size longer than said maximum expected pitch period but shorter than twice the maximum expected pitch period is used.

Tests have shown that the risk of reverberation is smaller for speech signals having relatively long pitch periods, compared to short pitch periods, because they actually change more slowly. Therefore, a composite pitch pattern is not needed for these signals, and it will be sufficient to have a frame or segment length that just allows a pattern of one full pitch length to be processed. Consequently, the segment size can be reduced to a value which is only slightly longer than the maximum expected pitch period, i.e. between the maximum expected pitch period and twice the maximum expected pitch period. Obviously, the shorter segment or frame length reduces the amount of data to be processed for each segment, and it is further reduced because the calculation of the composite signal can be avoided at least for speech signals with long pitch periods. For speech signals having a shorter pitch period it may still be possible to form a composite pitch pattern from e.g. two consecutive pitch periods.

In an expedient embodiment the method further comprises the step of providing, if the actual estimated pitch period of the segment is greater than half the segment size, the intermediate signal by using the copied fraction directly as the intermediate signal. This avoids the extra calculation of a composite signal.

If the actual estimated pitch period of a segment is less than half the segment size, the method may further comprise the steps of copying two consecutive fractions, each having a duration equal to the estimated pitch period, and providing the intermediate signal as an average of the two consecutive fractions. In this way reverberation may be minimized for speech with shorter pitch periods which actually have a higher risk for such reverberation.

When the method further comprises the steps of classifying a segment of the speech signal as a silent segment, if the content of speech information is below a preset threshold, and shortening a segment, if that segment and a number of immediately preceding segments have been classified as silent segments, to compensate for expansion of previous segments, it is possible to maintain the delay between the input signal and the (expanded) output signal at a very low level, thus providing a substantial real time conversion of the speech. This makes the algorithm more suited for use in mobile telephones in which it is desired to keep the expanded speech as close to real time as possible.

An embodiment especially expedient for use in mobile telephones is obtained when a segment size of 20 ms is used, because this segment size is also used by the existing speech signal processing in many mobile telephones, and thus, a great many computational resources can be saved by using the same segments for the speech expansion algorithm.

When a segment is expanded by inserting the intermediate signal pitch synchronously into the speech signal of the segment a plurality of times, higher expansion rates can be achieved without increasing the use of computational resources considerably.

A better result without the introduction of spikes or similar discontinuities in the insertion may be achieved when an overlapping window is used when copying said fraction and inserting said intermediate signal.

A typical use of the method is in portable communications devices, and in an expedient embodiment the method is used in a mobile telephone.

As mentioned, the invention also relates to a device adapted to convert the speech rate of a speech signal having a pitch period below a maximum expected pitch period. The device comprises means for dividing the speech signal into segments, means for estimating the pitch period of the speech signal in a segment, means for copying a fraction of the speech signal in the segment, said fraction having a duration equal to said estimated pitch period, means for providing from the fraction an intermediate signal having the same duration, and means for expanding the segment by inserting said intermediate signal pitch synchronously into the speech signal of the segment. When the device is adapted to use a segment size longer than said maximum expected pitch period but shorter than twice the maximum expected pitch period, a considerably smaller amount of data has to be processed for a frame, so that the method can be implemented with the limited computational resources of e.g. a mobile telephone.

In an expedient embodiment the device is further adapted to provide, if the actual estimated pitch period of the segment is greater than half the segment size, the intermediate signal by using the copied fraction directly as the intermediate signal. This avoids the extra calculation of a composite signal.

If the actual estimated pitch period of a segment is less than half the segment size, the device may further be adapted to copy two consecutive fractions, each having a duration equal to the estimated pitch period, and to provide the intermediate signal as an average of the two consecutive fractions. In this way reverberation may be minimized for speech with shorter pitch periods which actually have a higher risk for such reverberation.

When the device is further adapted to classify a segment of the speech signal as a silent segment, if the content of speech information is below a preset threshold, and to shorten a segment, if that segment and a number of immediately preceding segments have been classified as silent segments, to compensate for expansion of previous segments, it is possible to maintain the delay between the input signal and the (expanded) output signal at a very low level, thus providing a substantial real time conversion of the speech. This makes the algorithm more suited for use in mobile telephones in which it is desired to keep the expanded speech as close to real time as possible.

An embodiment especially expedient for use in mobile telephones is obtained when the device is adapted to use a segment size of 20 ms, because this segment size is also used by the existing speech signal processing in many mobile telephones, and thus, a great many computational resources can be saved by using the same segments for the speech expansion algorithm.

When the device is adapted to expand a segment by inserting the intermediate signal pitch synchronously into the speech signal of the segment a plurality of times, higher expansion rates can be achieved without increasing the use of computational resources considerably.

A better result without the introduction of spikes or similar discontinuities in the insertion may be achieved when the device is adapted to use an overlapping window when copying said fraction and inserting said intermediate signal.

In an expedient embodiment of the invention, the device is a mobile telephone, although it may also be other types of portable communications devices.

In another embodiment the device is an integrated circuit which can be used in different types of equipment.

Figure 2:
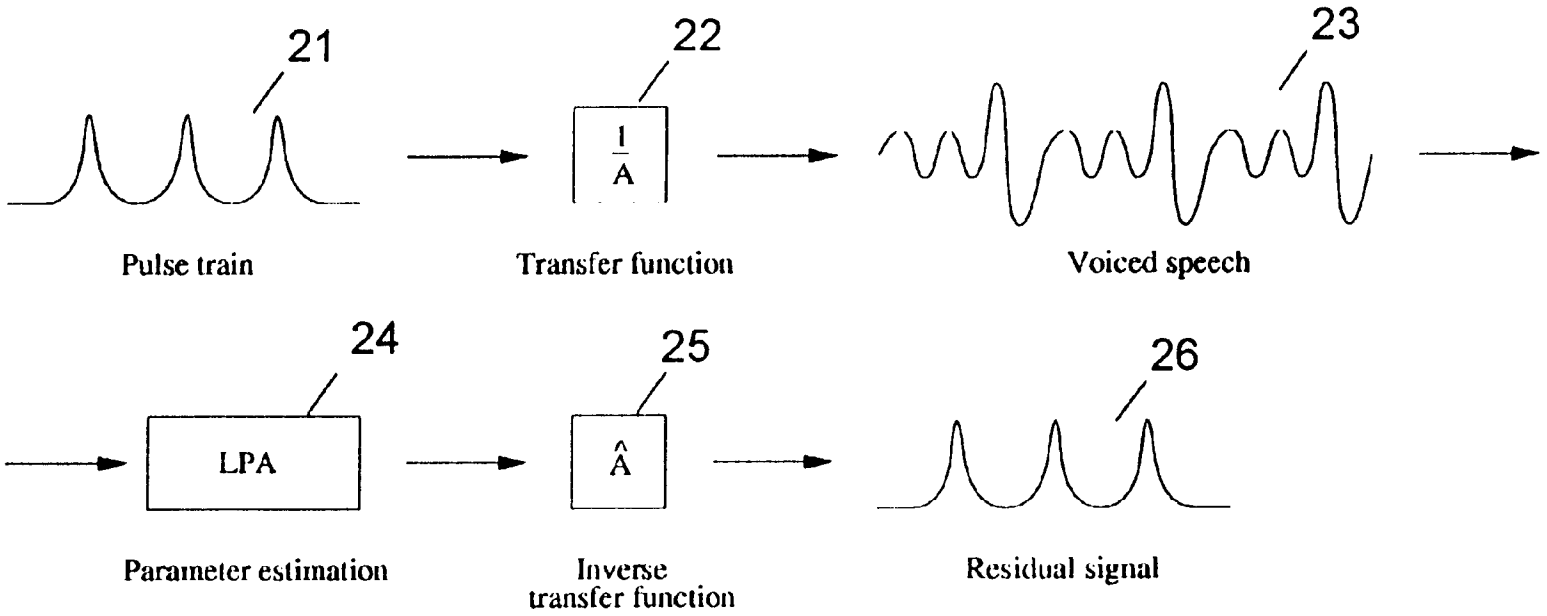
Figure 3A:
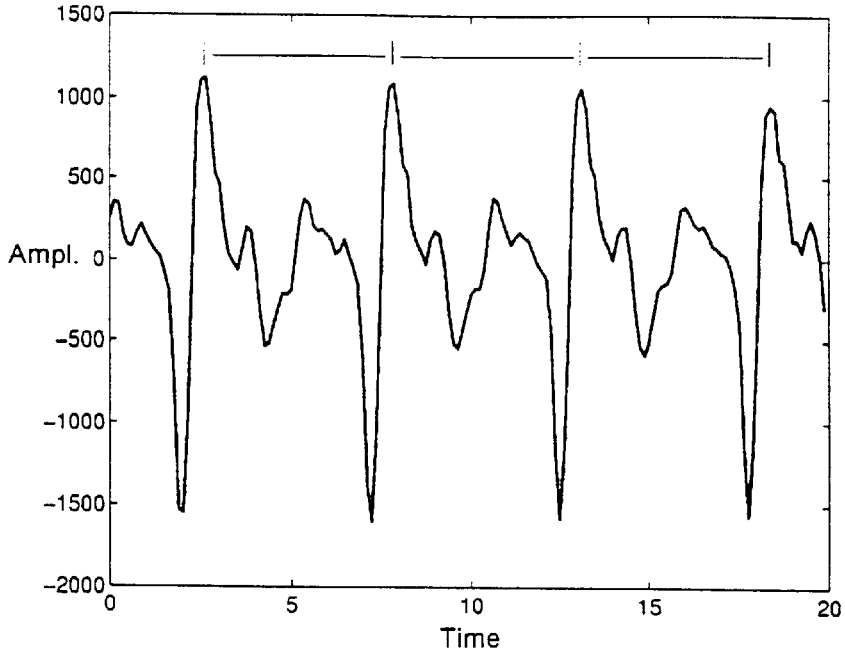
Figure 3B:
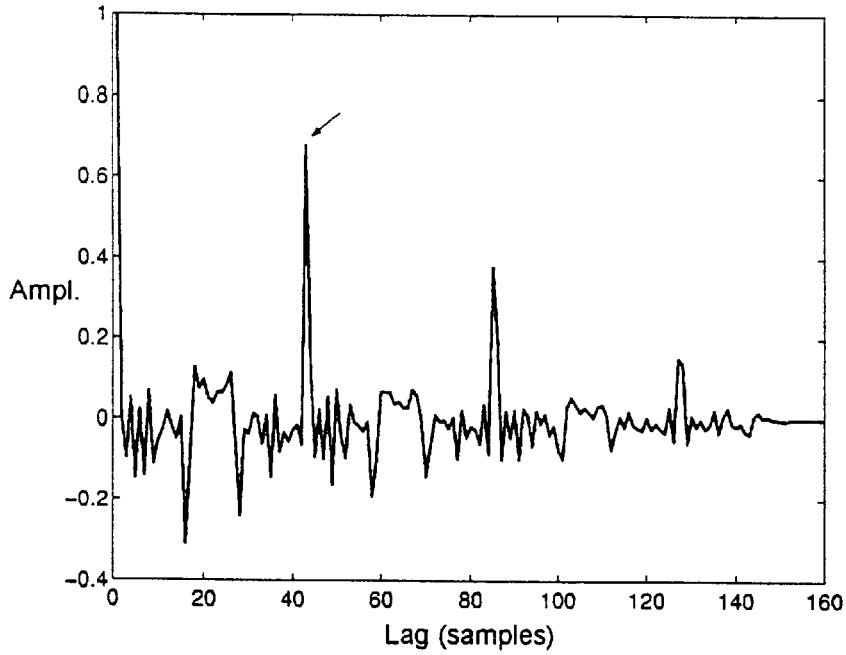
Figure 4:
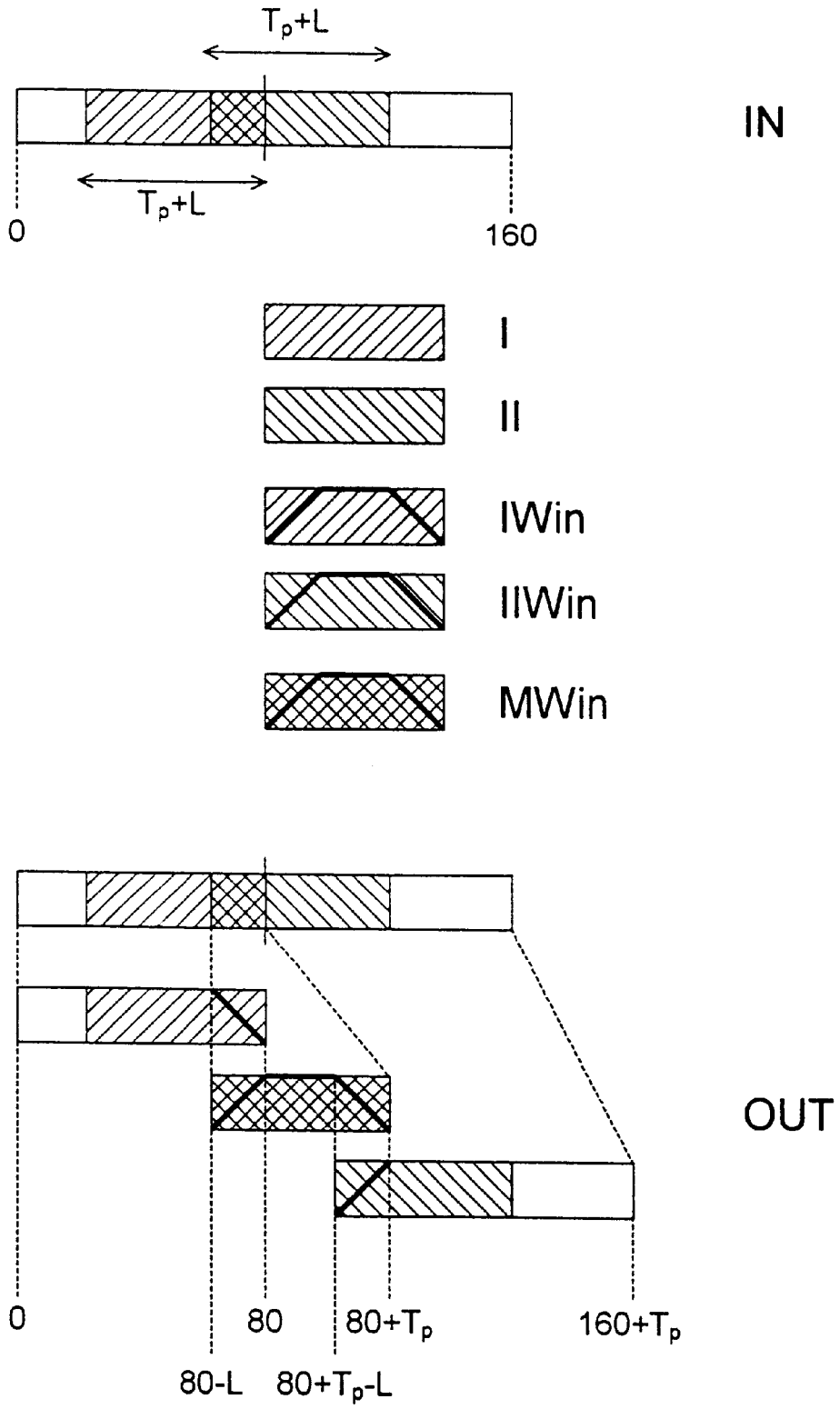
Figure 5:
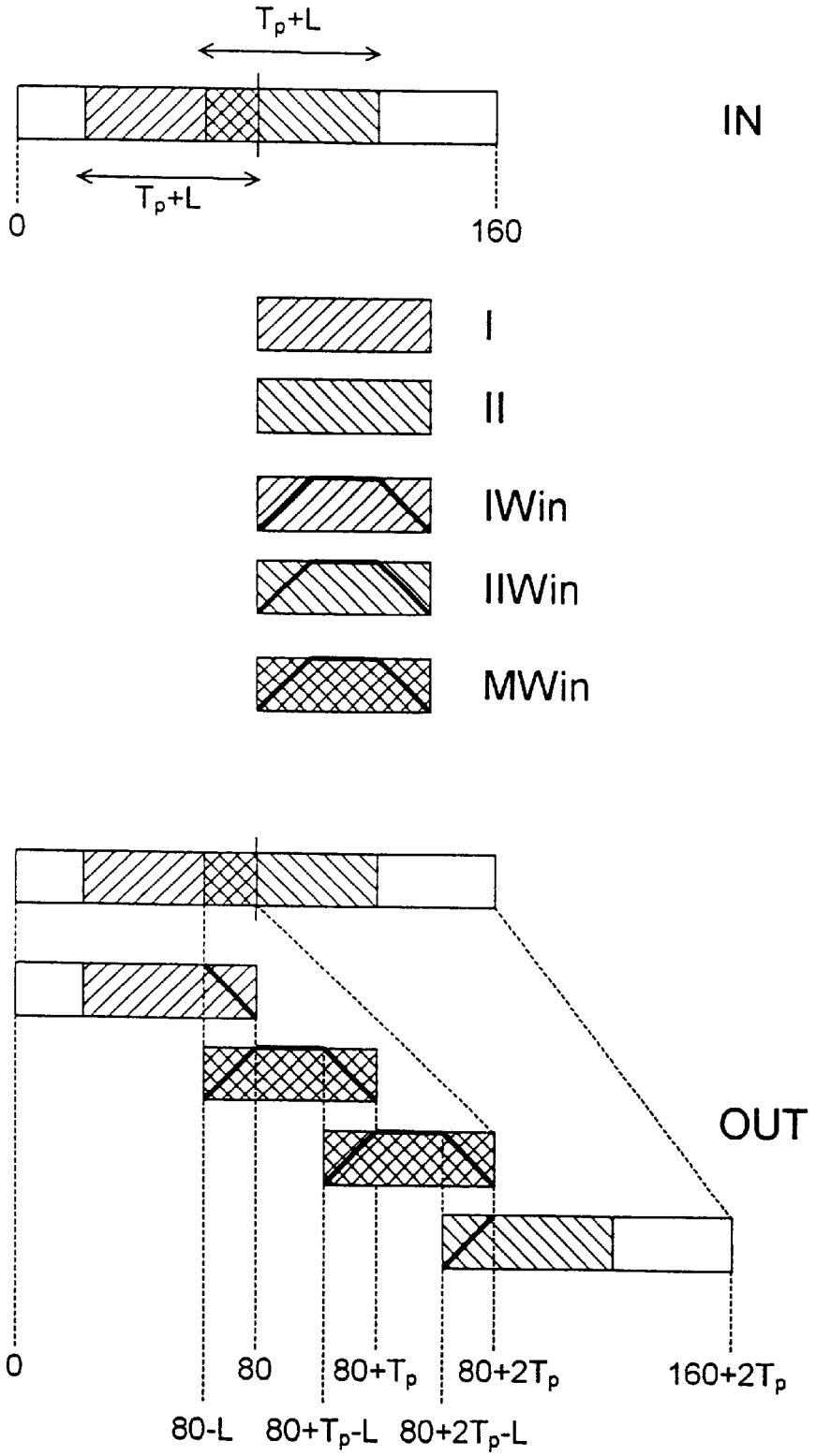
Figure 6:
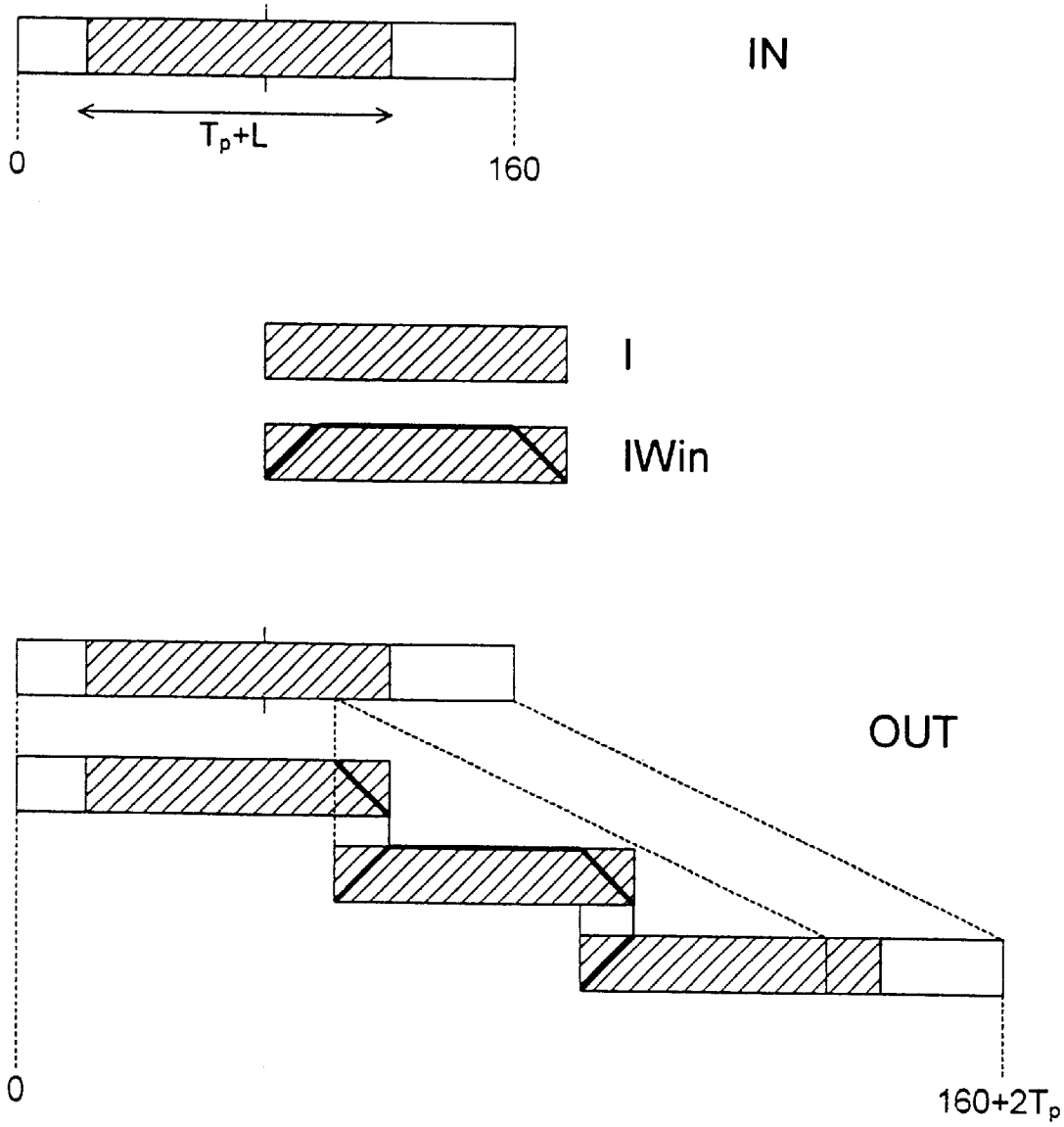
Figure 7:
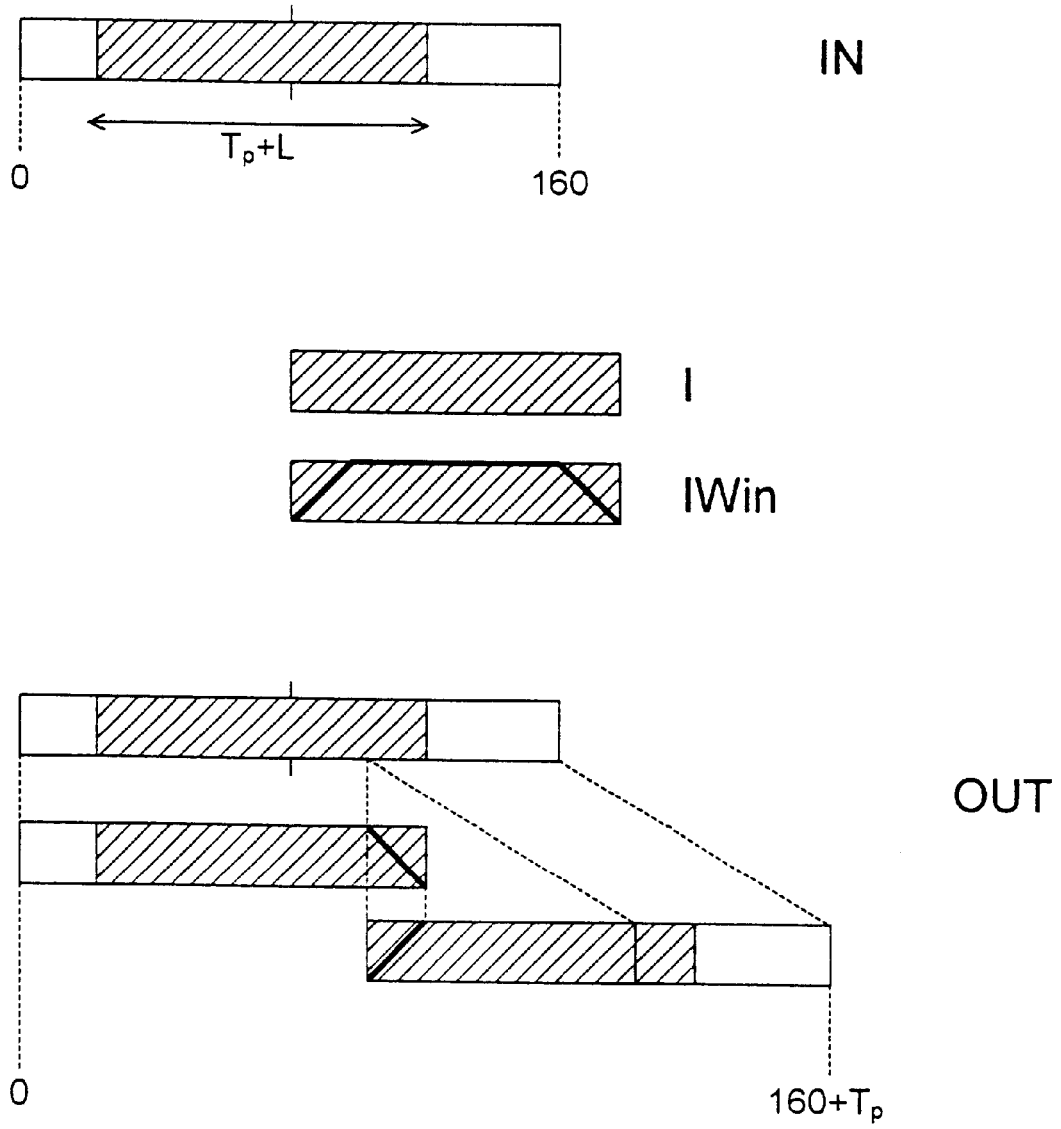

The invention will now be described more fully below with reference to the drawing, in which FIG. 1 shows a block diagram of a speech rate conversion system according to the invention, FIG. 2 shows a model for voiced speech production and extraction of an excitation signal from voiced speech, FIG. 3 shows an example of a voiced speech signal and the corresponding autocorrelation of a residual signal, FIG. 4 shows a diagram of a first extension algorithm used for speech signals with relatively short pitch periods, FIG. 5 shows an alternative embodiment of the algorithm of FIG. 4, FIG. 6 shows a diagram of a second extension algorithm used for speech signals with relatively long pitch periods, and FIG. 7 shows an alternative embodiment of the algorithm of FIG. 6.

FIG. 1 shows a block diagram of an example of a speech rate conversion system 1 in which the method and the device of the invention may be implemented. The shown speech rate conversion system can be used in a mobile telephone or a similar communications device.

A speech signal 2 is sampled in a sampling circuit 3 with a sampling rate of 8 kHz and the samples are divided into segments or frames of 160 consecutive samples. Thus, each segment corresponds to 20 ms of the speech signal. This is the sampling and segmentation normally used for the speech processing in a standard mobile telephone and thus, the sampling circuit 3 is a normal part of such a telephone.

Each segment or frame of 160 samples is then sent to a noise threshold unit 4 in which a classification step is performed which separates speech from silence. Frames classified as speech will be further processed while the others are sent to a silence shortening unit 5, which will be described later. The separation of speech from silence is a necessary operation when speech extension is to operate in real-time, since the extra time created by the extended speech is compensated by taking time from the silence or noise part of the signal.

The classification is based on an energy measurement in combination with memory in the form of recorded history of energy from previous frames. It is presumed that the background noise changes slowly while the speech envelope changes more rapidly. First, a threshold is calculated. The short-time energy of each frame is calculated, and the short-time energy values of the latest 150 frames are continuously saved. The energy values of those frames classified as silence are selected and the mean energy is calculated over these selected energy values. Also the minimum energy value of the selected energy values is stored. The threshold is calculated by adding the difference between the mean value and the minimum value, multiplied by a pre-selected factor, to the mean energy. To decide whether a given frame is speech or silence the energy of the current frame is simply compared with the threshold value. If the energy of the frame exceeds this value it is classified as speech, otherwise it is classified as silence.

The frames classified as speech are then sent to the voiced/unvoiced classification unit 6, because a separation of the speech into voiced and unvoiced portions is needed before an extension can be made. This separation can be performed by several methods, one of which will be described in detail below.

First, however, the nature of speech signals will be mentioned briefly. In a classical approach a speech signal is modelled as an output of a slowly time-varying linear filter. The filter is either excited by a quasi-periodic sequence of pulses or random noise depending on whether a voiced or an unvoiced sound is to be created. The pulse train which creates voiced sounds is produced by pressing air out of the lungs through the vibrating vocal cords. The period of time between the pulses is called the pitch period and is of great importance for the singularity of the speech. On the other hand, unvoiced sounds are generated by forming a constriction in the vocal tract and produce turbulence by forcing air through the constriction at a high velocity.

As speech is a varying signal also the filter has to be time-varying. However, the properties of a speech signal change relatively slowly with time. It is reasonable to believe that the general properties of speech remain fixed for periods of 10–20 ms. This has led to the basic principle that if short segments of the speech signal are considered, each segment can effectively be modelled as having been generated by exciting a linear time-invariant system during that period of time. The effect of the filter can be seen as caused by the vocal tract, the tongue, the mouth and the lips.

As mentioned, voiced speech can be interpreted as the output signal from a linear filter driven by an excitation signal. This is shown in the upper part of FIG. 2 in which the pulse train 21 is processed by the filter 22 to produce the voiced speech signal 23. A good signal for the voiced/unvoiced classification is obtained if the excitation signal can be extracted from the speech. By estimating the filter parameters A in the block 24 and then filtering the speech through an inverse filter 25 based on the estimated filter parameters, a signal 26 similar to the excitation signal can be obtained. This signal is called the residual signal. This process is shown in the lower part of FIG. 2. The blocks 24 and 25 are included in the voiced/unvoiced classification unit 6 in FIG. 1.

The estimation of the filter parameters is based on an all-pole modelling which is performed by means of the method called linear predictive analysis (LPA). The name comes from the fact that the method is equivalent with linear prediction. This method is well known in the art and will not be described in further detail here.

A classifying signal is then produced by calculating the autocorrelation function of the residual signal and scaling the result to be between 1. As the inverse filtering has removed much of the smearing introduced by the filter, the possibility of a clearer peak is higher compared to calculating the autocorrelation directly of the speech frame. A voiced/unvoiced decision is then made by comparing the value of the highest peak in the classifying signal to a threshold value, because a sufficiently high peak in the classifying signal means that a pulse train was actually present in the residual signal and thus also in the original speech signal of the frame.

Alternatively, the voiced/unvoiced decision can be made by a simple comparison of the power or energy level of the frame with a threshold similar to the one used in the noise threshold unit 4, just with a higher threshold value, because signals below a certain power level primarily contain consonants or semi-vowels, which are typically unvoiced. However, the results of this method is not as precise as those obtained by the above-mentioned classification.

If the frame is decided as unvoiced it will be sent directly to a combination or concatenation unit 7. Otherwise, i.e. if it is decided as voiced, it will be forwarded to the pitch estimation unit 8, which will be described below.

The pitch is estimated as a preparation for the extension process which should be pitch synchronous. The general idea of the estimation originates in the speech model described above, where the pitch represents the period of the glottal excitation. As the pitch expresses the natural quality and singularity of the speech it is important to carry out a good estimation of the pitch.

The estimation of the pitch is based on the autocorrelation of the residual signal, which is obtained by LPA as described above in the voiced/unvoiced classification. This can be done because the highest peak in the autocorrelation of the residual signal represents the pitch period and can thus be used as an estimate thereof. By thus reusing data the complexity of the method is lowered. FIG. 3*a* shows an example of a 20 ms segment of a voiced speech signal and FIG. 3*b* the corresponding autocorrelation function of the residual signal. It will be seen from FIG. 3*a* that the actual pitch period is about 5.25 ms corresponding to 42 samples, and thus the pitch estimation should end up with this value.

The first step in the estimation of the pitch is to apply a peak picking algorithm to the autocorrelation function provided by the unit 6. This is done with a peak detector which identifies the maximum peak (i.e. the largest value) in the autocorrelation function. The index value, i.e. the sample number or the lag, of the maximum peak is then used as an estimate of the pitch period. In the case shown in FIG. 3*b* it will be seen that the maximum peak is actually located at a lag of 42 samples. The search of the maximum peak is only performed in the range where a pitch period is likely to be located. In this case the range is set to 60–333 Hz.

The result of the estimation is forwarded to the extension unit 9 along with the speech frame. The extension algorithm is a time-domain based method which operates on whole pitch period blocks. The use of this technique means that unwanted changes of the pitch can be avoided, and thereby the singularity of the speech can be preserved.

The extension algorithm described below is a modified version of a Pitch Synchronous OverLap Add (PSOLA) method. In brief, the algorithm makes a copy of one or two pitch periods and adds it or them to the original speech data, possibly with some overlap. The modifications are due to the fact that the relatively short frame or segment length of 20 ms is used.

Depending on the estimated pitch period, two different approaches are used in the extension of the speech. The first approach is used for relatively short pitch periods. This could be pitch periods below 8.75 ms corresponding to 70 samples using a sample rate of 8 kHz. It also corresponds to pitch frequencies above 114 Hz. The second approach is then used for pitch periods above 8.75 ms, i.e. relatively long pitch periods. The reason for using two different approaches is that due to the short frame or segment length of 20 ms only one full pitch length of the signal, including a certain overlap, can be extracted for extension purposes for signals having long pitch periods, while two consecutive pitch periods (and overlap) may be extracted for signals with shorter pitch periods.

The first approach utilizes the circumstance that the pitch period is relatively short. The different steps performed in this approach are illustrated in FIG. 4. From the incoming frame, two subsequent pitch periods $T_p$, along with an extra piece corresponding to the overlapping part L, are copied. The overlapping part could be set to 10% of $T_p$. A window is applied to the two segments I and II, thereby creating what will be referred to as segment IWin and segment IIWin. The window being used could be a raised cosine window or trapezoid window. Of the windowed segments an average is calculated which is denoted MWin. By forming an averaged segment unnecessary repetitions of an already existing segment can be avoided. Thereby the risk of undesired artifacts, such as reverberation, can be reduced.

Inserting the segment MWin with an overlap of L samples with the original frame now causes the extension of the speech to be carried out. As will be seen from the lower part of FIG. 4 showing the outgoing data, the extended frame now has a length of $160+T_p$ samples instead of the original 160 samples. If needed, the frame can be further extended by a chosen amount of segments by adding Mwin, including overlap again, the desired number of times. FIG. 5 is similar to FIG. 4, but with MWin added twice so that the extended frame length is $160+2T_p$ samples.

In the second approach the pitch periods are longer. The first approach cannot be used as the frame length is not long enough to include two pitch periods. A demonstration of the stages in the second approach can be seen in FIG. 6. From the incoming frame only one segment I of the length $T_p+L$ is copied out and windowed with a chosen window. Also in this case the length of L corresponds to 10% of $T_p$. Then the windowed segment IWin is inserted with an overlap of L samples with the original samples. The insertion of IWin can be seen in the lower part of FIG. 6 showing the outgoing data, in which it can be seen that the extended frame now has a length of $160+2T_p$ samples instead of the original 160 samples, because the original pitch length segment is used before as well as after the inserted IWin.

Also in this approach, the frame can be further extended by adding IWin including overlap again. However, as shown in FIG. 7, the original pitch length segment could also be used only twice so that the extended frame length is $160+T_p$ samples.

It should be noted that different overlap percentages could be used. A shorter overlap length means that longer pitch periods can be extended by means of the first approach. However, if the overlap becomes too small, the overlapping procedure will lose its effect. The overlap of 10% used above seems to be good compromise.

The extended frame is now sent to the concatenation unit 7 where it will be merged with the other frames.

As is seen above, the speech extension causes delays in the speech that are not desirable, especially in a mobile telephone environment. To avoid this delay some parts of the input signal have to be removed. A natural choice is to use the speech pauses which consist of silence only. A shortening algorithm fulfilling the demands for real time is performed in the shortening unit 5 and will be described below.

Before the shortening of the silent parts can start, a condition has to be fulfilled. The current frame and the preceding three frames must be silent frames. If this condition is satisfied, the number of samples corresponding to the extended part is removed. Also fractions of frame can be removed in order to maintain real time.

There are two reasons for the above-mentioned condition.

The first reason is that if the environment is quite noisy, unvoiced sounds can be misclassified as silence and these misclassified frames must not be removed. The assumption that has been used is that unvoiced speech often follows voiced speech. If a frame of unvoiced speech is misclassified as silence, it is reasonable to believe that either a voiced sound will occur soon after or that the speech portion has ended. In whichever case the utilization of the above-mentioned condition prevents these unvoiced frames from being removed.

The second reason for the condition is that there are pauses in the speech which are necessary for the natural flow of the speech. If they are removed, the speech is harder to understand, which is the opposite result of what is wanted.

When the frames classified as silence have been shortened to compensate for the extension of the voiced frames, they are sent to the combination unit 7.

As is seen above, an incoming frame can take three ways in the system to the concatenation or combination unit 7 depending on whether the frame is classified as silence, unvoiced speech or voiced speech. Independent of which way the frames have taken, the incoming frames must be sent out in the same order as they arrived, irrespective of whether they have been altered or not. Therefore, the combination unit 7 can be viewed as a First In First Out (FIFO) buffer.

Although a preferred embodiment of the present invention has been described and shown, the invention is not restricted to it, but may also be embodied in other ways within the scope of the subject-matter defined in the following claims.

Thus, the autocorrelation function may be calculated directly of the speech signal instead of the residual signal, or other conformity functions may be used instead of the autocorrelation function. As an example, a cross correlation could be calculated between the speech signal and the residual signal. Further, different sampling rates may be used.

What is claimed is:

1. A method of converting the speech rate of a speech signal having a pitch period below a maximum expected pitch period, the method comprising the steps of:

dividing the speech signal into segments, estimating the pitch period of the speech signal in a segment, copying a fraction of the speech signal in the segment, the fraction having a duration equal to the estimated pitch period, providing from the fraction an intermediate signal having the same duration, and expanding the segment by inserting the intermediate signal pitch synchronously into the speech signal of the segment, wherein a segment size longer than the maximum expected pitch period and shorter than twice the maximum expected pitch period is used.

2. A method according to claim 1, further comprising:

providing, if the actual estimated pitch period of the segment is greater than half the segment size, the intermediate signal by using the copied fraction directly as the intermediate signal.

3. A method according to claim 1 or 2, further comprising:

copying, if the actual estimated pitch period of the segment is less than half the segment size, two consecutive fractions, each fraction having a duration equal to the estimated pitch period, and providing the intermediate signal as an average of the two consecutive fractions.

4. A method according to claim 1 or 2, further comprising:

classifying a segment of the speech signal as a silent segment, if the content of speech information is below a preset threshold, shortening a segment, if that segment and a number of immediately preceding segments have been classified as silent segments, to compensate for expansion of previous segments.

5. A method according to claim 1 or 2, wherein a segment size of 20 ms is used.

6. A method according to claim 1 or 2, wherein the segment is expanded by inserting the intermediate signal pitch synchronously into the speech signal of the segment a plurality of times.

7. A method according to claim 1 or 2, wherein an overlapping window is used when copying the fraction and inserting the intermediate signal.

8. A method according to claim 1 or 2, wherein the method is used by a mobile telephone.

9. A device adapted to convert the speech rate of a speech signal having a pitch period below a maximum expected pitch period, the device comprising:

means for dividing the speech signal into segments, means for estimating the pitch period of the speech signal in a segment, means for copying a fraction of the speech signal in the segment, the fraction having a duration equal to the estimated pitch period, means for providing from the fraction an intermediate signal having the same duration, and means for expanding the segment by inserting the intermediate signal pitch synchronously into the speech signal of the segment, wherein the device is adapted to use a segment size longer than the maximum expected pitch period and shorter than twice the maximum expected pitch period.

10. A device according to claim 9, wherein the device is further adapted to provide, if the actual estimated pitch period of the segment is greater than half the segment size, the intermediate signal by using the copied fraction directly as the intermediate signal.

11. A device according to claim 9 or 10, wherein the device is further adapted to copy, if the actual estimated pitch period of the segment is less than half the segment size, two consecutive fractions, each fraction having a duration equal to the estimated pitch period, and to provide the intermediate signal as an average of the two consecutive fractions.

12. A device according to claim 9 or 10, wherein the device is further adapted to:

classify a segment of the speech signal as a silent segment, if the content of speech information is below a preset threshold, shorten a segment, if that segment and a number of immediately preceding segments have been classified as silent segments, to compensate for expansion of previous segments.

13. A device according to claim 9 or 10, wherein the device is adapted to use a segment size of 20 ms.

14. A device according to claim 9 or 10, wherein the device is adapted to expand the segment by inserting the intermediate signal pitch synchronously into the speech signal of the segment a plurality of times.

15. A device according to claim 9 or 10, wherein the device is adapted to use an overlapping window when copying the fraction and inserting the intermediate signal.

16. A device according to claim 9 or 10, wherein the device comprises a mobile telephone.

17. A device according to claim 9 or 10, wherein the device comprises an integrated circuit.

* * * * *

UNITED STATES PATENT AND TRADEMARK OFFICE

CERTIFICATE OF CORRECTION

PATENT NO. : 6,763,329 B2
DATED : July 13, 2004
INVENTOR(S) : Cecilia Brandel and Henrik Johannisson It is certified that error appears in the above-identified patent and that said Letters Patent is hereby corrected as shown below:

Column 6,
Line 9, please insert -- ± -- before the "1".

Signed and Sealed this

Thirteenth Day of September, 2005

JON W. DUDAS
*Director of the United States Patent and Trademark Office*